US007946243B1

(12) United States Patent
Ulrich

(10) Patent No.: US 7,946,243 B1
(45) Date of Patent: May 24, 2011

(54) DOUBLE ACTING LIFT MECHANISM FOR BOAT PLATFORM

(76) Inventor: Richard Ulrich, Fort Lauderdale, FL (US)

( * ) Notice: Subject to any disclaimer, the term of this patent is extended or adjusted under 35 U.S.C. 154(b) by 0 days.

(21) Appl. No.: 12/367,107

(22) Filed: Feb. 6, 2009

Related U.S. Application Data

(60) Provisional application No. 61/027,181, filed on Feb. 8, 2008.

(51) Int. Cl.
*B63B 17/00* (2006.01)

(52) U.S. Cl. ..... 114/362

(58) Field of Classification Search ..... 114/363, 114/48, 362
See application file for complete search history.

(56) References Cited

U.S. PATENT DOCUMENTS

| | | | | |
|---|---|---|---|---|
| 5,544,606 | A * | 8/1996 | Schmidt, Jr. | 114/48 |
| 6,591,770 | B1 * | 7/2003 | Blackmore | 114/48 |
| 6,786,170 | B2 * | 9/2004 | Trowbridge | 114/259 |
| 6,938,572 | B1 * | 9/2005 | Besecker et al. | 114/361 |
| 7,293,521 | B1 * | 11/2007 | Johns et al. | 114/259 |

* cited by examiner

*Primary Examiner* — Stephen Avila
(74) *Attorney, Agent, or Firm* — Daniel S. Polley, P.A.

(57) ABSTRACT

A second stage lift assembly for a moveable boat stern platform is disclosed and provides the ability to raise the moveable platform up an additional higher amount as compared to it's in-line level with the boat's walk-on deck or fixed platform. By being raised higher when the boat is moving, the moveable platform avoids dragging problems often encountered where the moveable platform remains at the same height as the walk-on deck or fixed platform.

4 Claims, 11 Drawing Sheets

SECOND STAGE STANDARD SCENARIO (UP)

SECOND STAGE STANDARD SCENARIO (DOWN)

SECOND STAGE REVERSE SCENARIO (UP & DOWN SHOWN)

SECOND STAGE CONSTRUCTION SPECIFICATIONS (REVERSE SCENARIO SHOWN).

DOUBLE ACTING LIFT MECHANISM FOR BOAT PLATFORM

This application claims priority to and the benefit of U.S. Application Ser. No. 61/027,181, filed Feb. 8, 2008, which is incorporated by reference in its entirety.

BACKGROUND OF THE INVENTION

Many new boat styles include a very low deck at the boat's stern that is close to the water line. Some boats have walk-out decks and/or fixed platforms that are also close to the waterline. This deck/platform configuration is for aesthetic cosmetic or practical purposes. When installing a moveable platform at the stern of a boat, approximately 4 to 5 feet of an extension is typically realized. It is preferable that the moveable platform line up with the rear walk-out deck or fixed platform so that it acts as an extension of the boat stern. Therefore, the moveable platform is installed so that it is at the same height as the existing stern of the boat during use.

One inherent problem with the moveable platform is that it typically extends beyond the stern of the boat at only 6 to 8 inches above the waterline when it is aligned with the boat deck. As the boat gets under way the stern dips and a wave or trailing wave is created. The moveable platform could drag in the water. The dragging of the moveable platform in the water can cause vibration and/or lead to performance problems. Additionally, the drag of the moveable platform can alter the way the boat planes, thereby altering the way the boat performs or damaging the boat and/or moveable platform if the drag is not eliminated. Also, in open seas the moveable platform is subject to the action of the waves without the protection of the ship's hull. The present invention is directed to addressing the above-noted problems.

SUMMARY OF THE INVENTION

While addressing the above noted problems, the present invention has also been designed to accommodate both functionality and aesthetics of the walk-out decks and/or fixed platforms on modern boats. With the present invention, a conventional first stage lift or standard lift up is provided which brings the moveable platform in line with the existing stern portion of the boat. Thus, the moveable platform is at the same, or substantially the same, height as the walk-out deck and/or fixed platform. This is where the boat owner wants it for convenience and ease of use. The moveable platform can remain in this in line position when the boat is not under way or is idling, as the boat is not creating any waves, or at least not any significant or relevant size waves. However, when the boat owner is in the open sea or begins to get under way, the above noted drag problems can occur. The present invention eliminates these problems by raising the moveable platform higher above the walk-out deck and/or fixed platform at the boat's stern.

The second stage assembly or mechanism of the moveable platform lift system provides additional functionality to a conventional lift system, by providing the ability to raise the moveable platform up an additional higher amount as compared to the standard or conventional lift (e.g. between 12 to 14 inches higher, though such is not considered limiting and other dimensions and/or ranges higher and lower can be selected and all are considered within the scope of the invention). As such, before the boat owner gets under way or if the boat is in rough seas, he or she merely activates the second stage assembly to raise the moveable platform up to the second stage/higher level (i.e. 12 or 14 inches, etc.). The platform may still be strapped (secured) to the watercraft in this raised position as is also done with conventional lift systems. Once the boat has stopped or is idling, the moveable platform can be lowered to it's in-line level with the walk-on deck and/or fixed platform or can be further lowered to its bottom position depending on its then intended use.

When the platform is either in a first stage or second stage up position the platform can be lowered down even with the water or under the water similar to a conventional lift, by pressing the down button on the controller (i.e. dashboard controls, wired handheld control, wireless handheld control etc.). The platform can lowered to a minimum of approximately 18 inches below the water level, though such is not considered limiting, and other dimensions and/or ranges higher or lower can be selected and are considered within the scope of the invention. Pressing the up button on the controller can raise the moveable platform up and out of the water to its standard level in line with the rear walk-out deck and/or fixed platform (first stage). At this point the platform can come up inline or level with the stern of the boat to provide an aesthetically pleasing look and a functional extension of the boat. Additionally, a relatively small safety gap (i.e. one inch, etc.) is provided between the edge of the movable platform and the walk-on deck and/or fixed platform of the boat, which can be a reduced sized gap as compared to conventional lifts.

To bring the movable platform from the first stage to the second stage, the controller is again used to activate the mechanism to lift the platform up to the second level (i.e. bringing it up an additional 12 to 14 inches, etc.). The second stage level provides the needed functionality of lifting the platform about 20 plus inches above the water (or other higher or lower dimension) such that the movable platform is safely above the trailing wave or the wave caused by the boat or waves caused by rough seas. At the second stage level, the platform can be secured thereby stabilizing everything, such that the boat can move forward and operate safely at higher speeds and regardless of the condition of the seas.

DETAILED DESCRIPTION OF THE INVENTION

Figure 1:
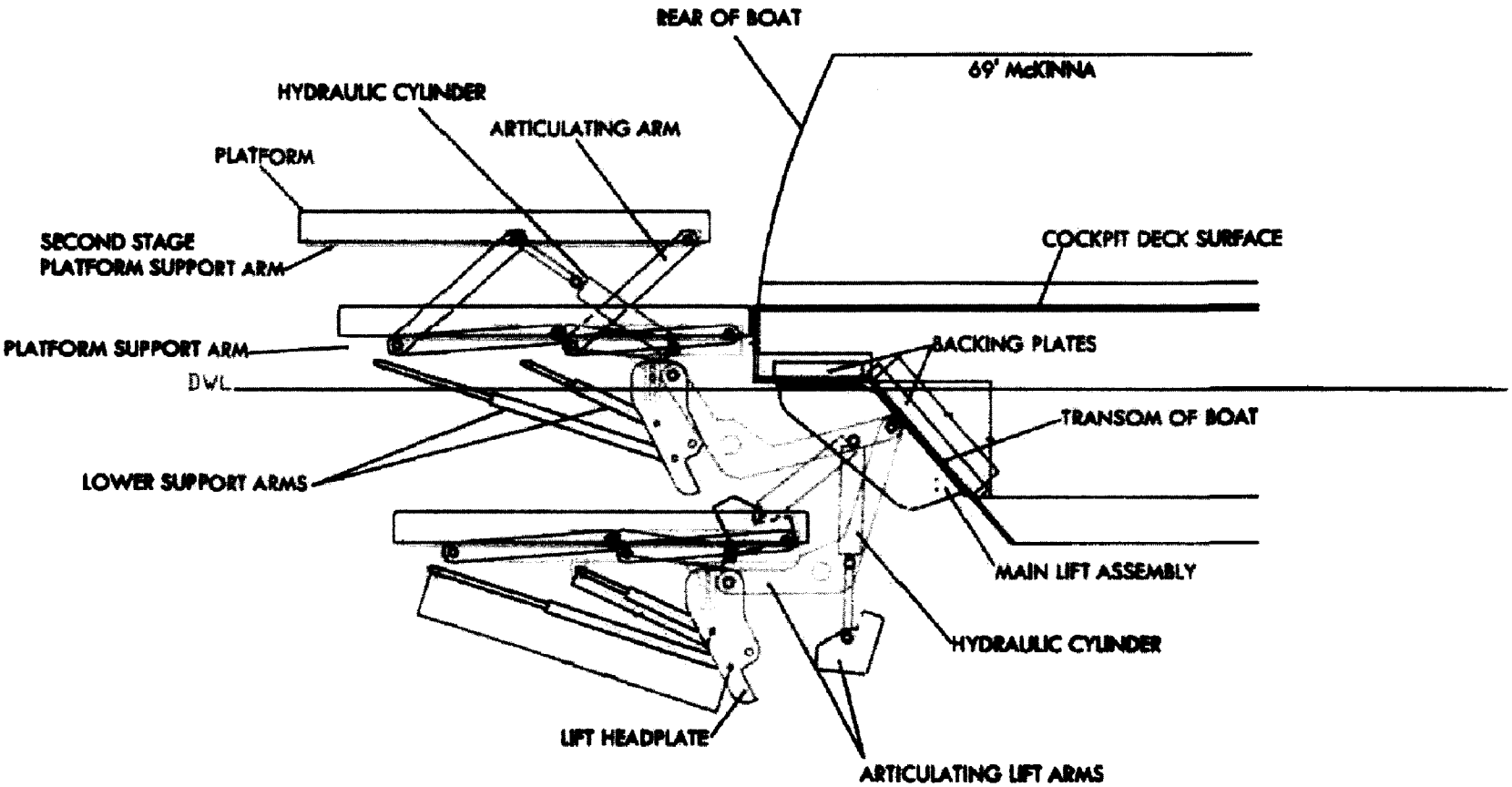
FIG. 1 is a side elevational view showing the platform in three separate positions through use of and in accordance with the present invention double acting lift mechanism.
Figure 2B:
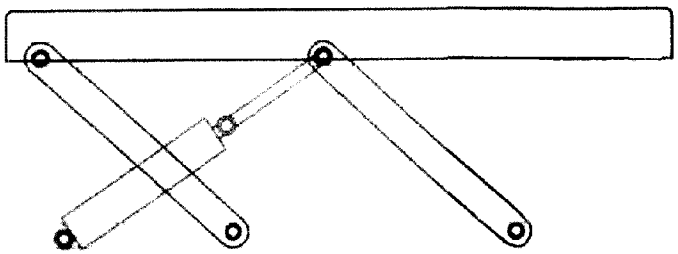
FIGS. 2*a*, 2*b* and 2*c* are side elevational views showing the second stage assembly in up and down scenarios.
Figure 2A:
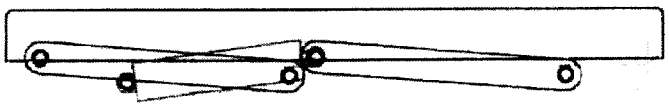
Figure 2C:
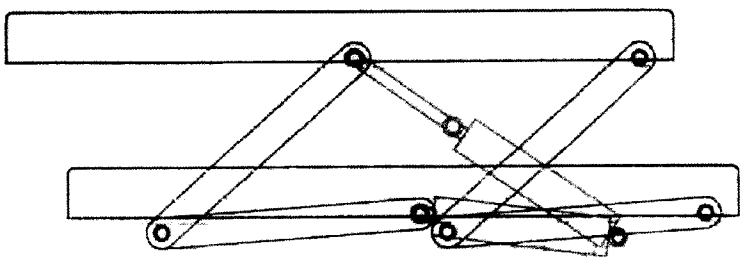
Figure 3:
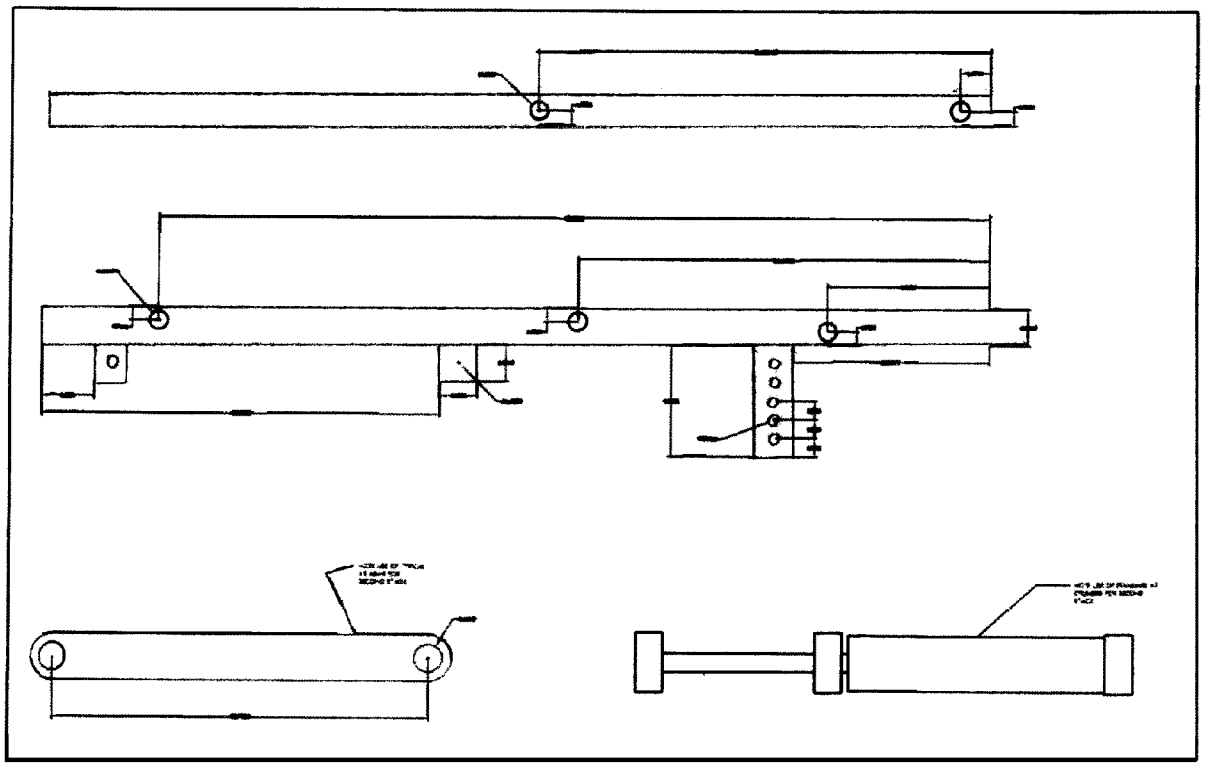
FIG. 3 illustrates certain construction specifications for one embodiment of the second stage assembly.
Figure 4:
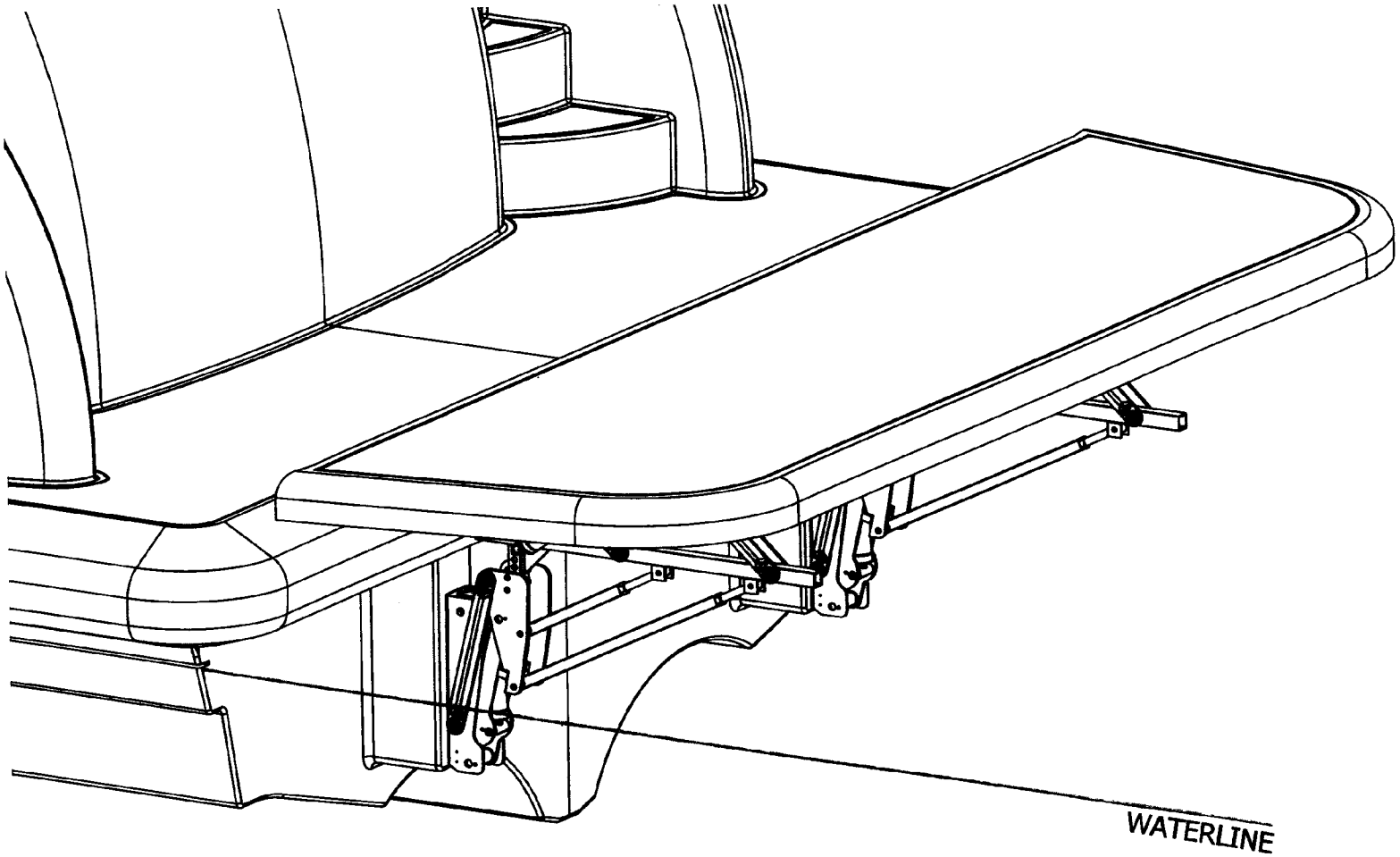
FIG. 4 is a perspective view showing the platform in an uppermost position through use of and in accordance with the present invention.
Figure 5:
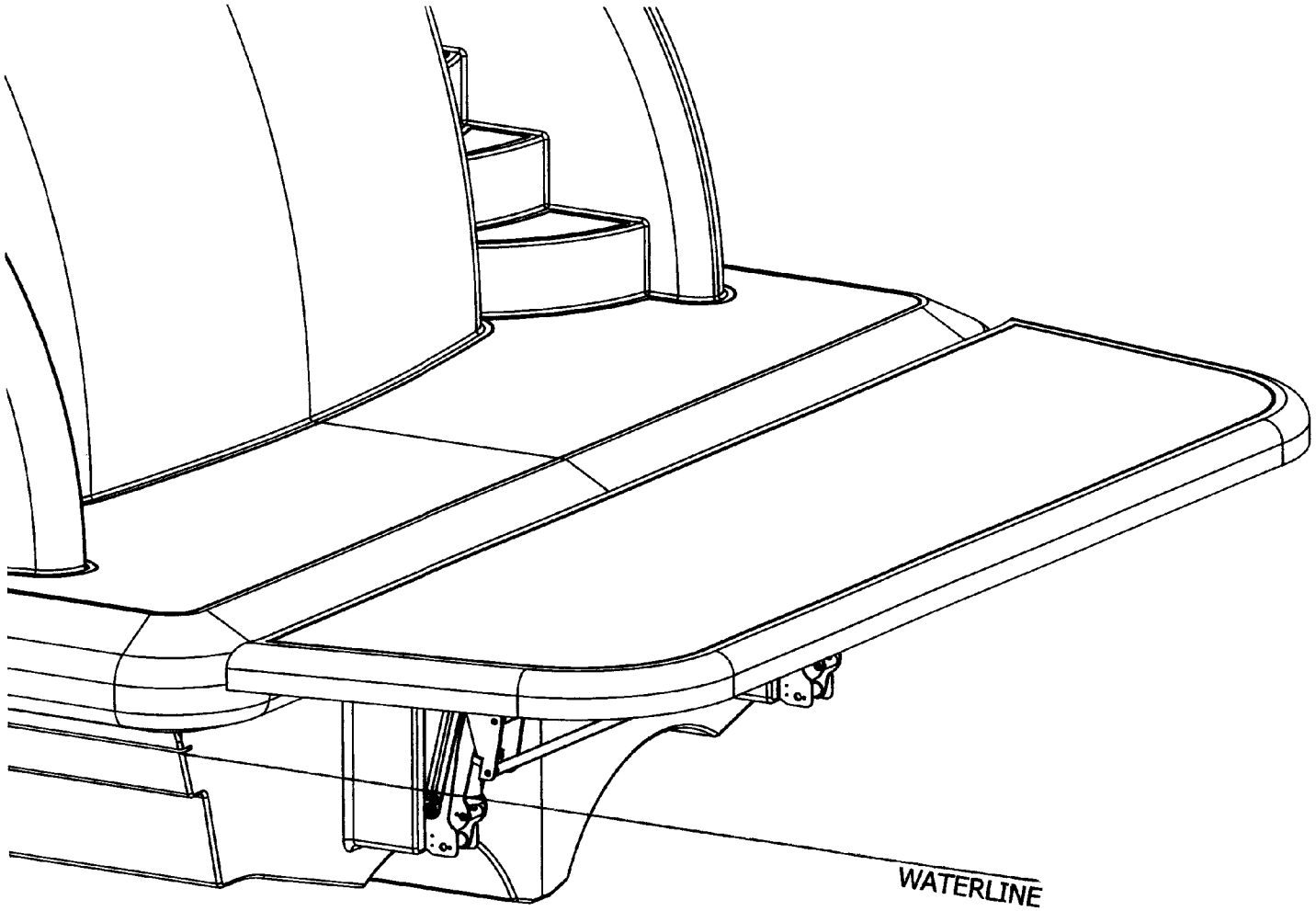
FIG. 5 is a perspective view showing the platform in an in-line position through use of and in accordance with the present invention.
Figure 6:
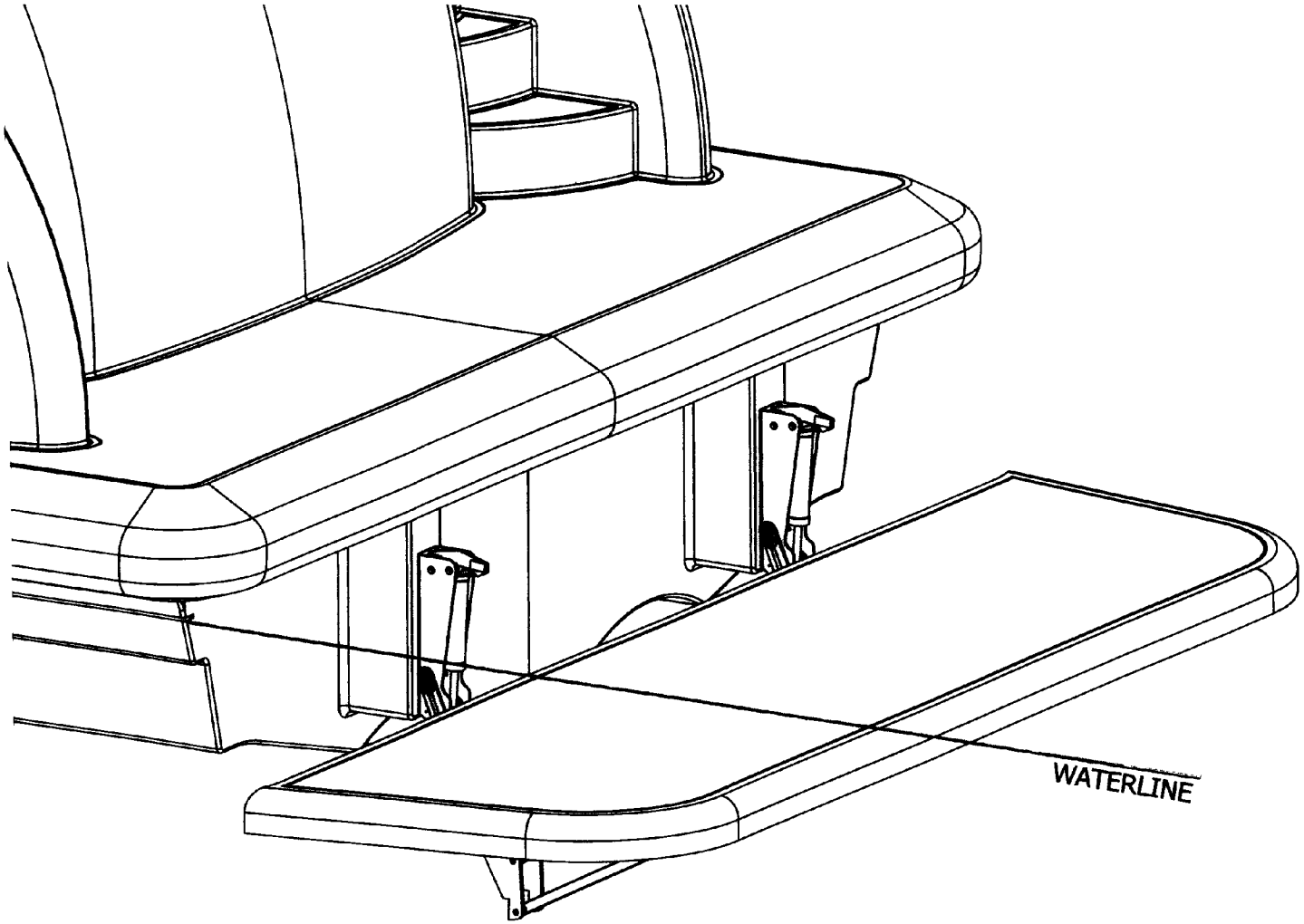
FIG. 6 is a perspective view showing the platform in a lowermost position through use of and in accordance with the present invention.
Figure 7:
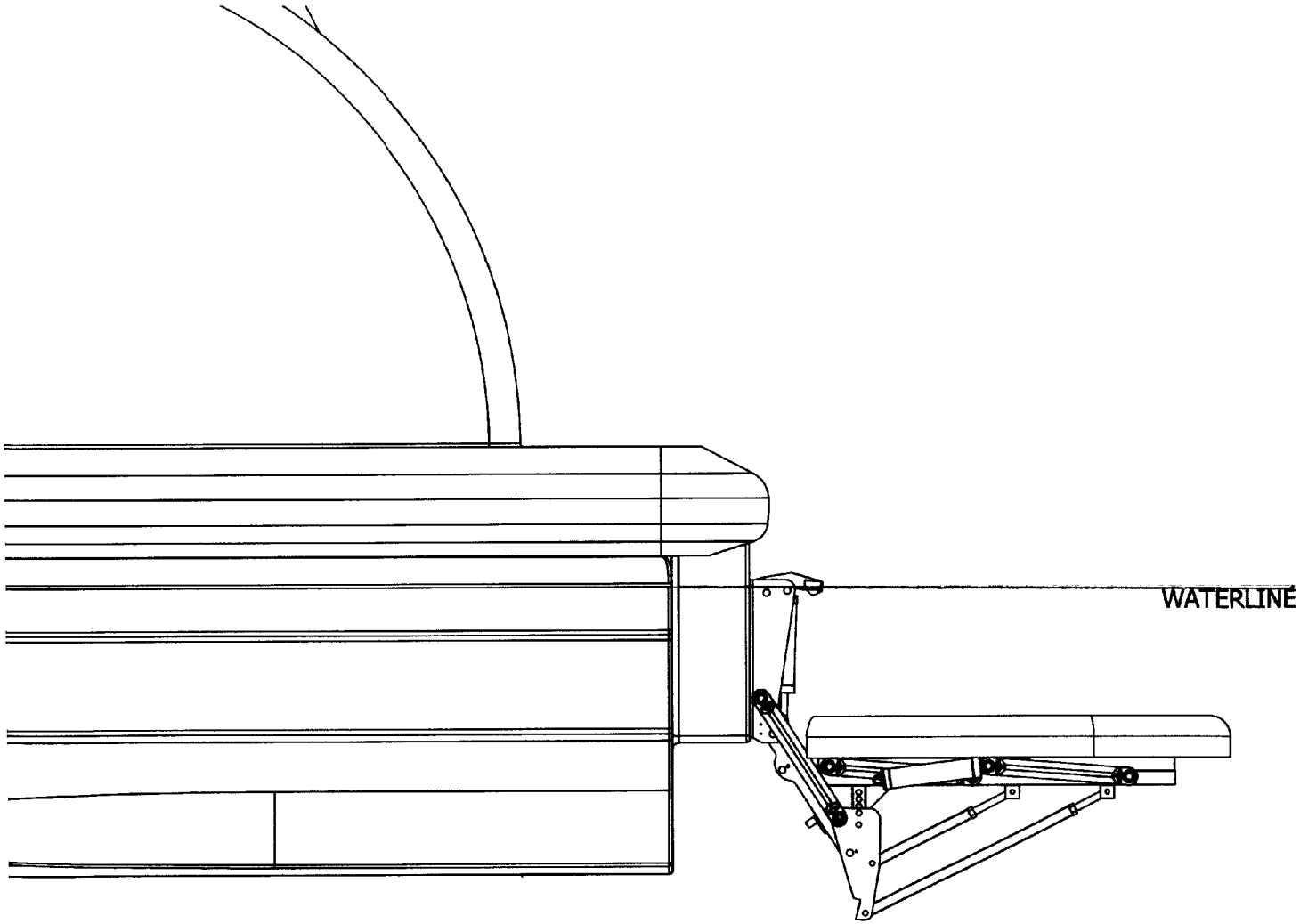
FIG. 7 is a side elevational view showing the platform in a lowermost position through use of and in accordance with the present invention.
Figure 8:
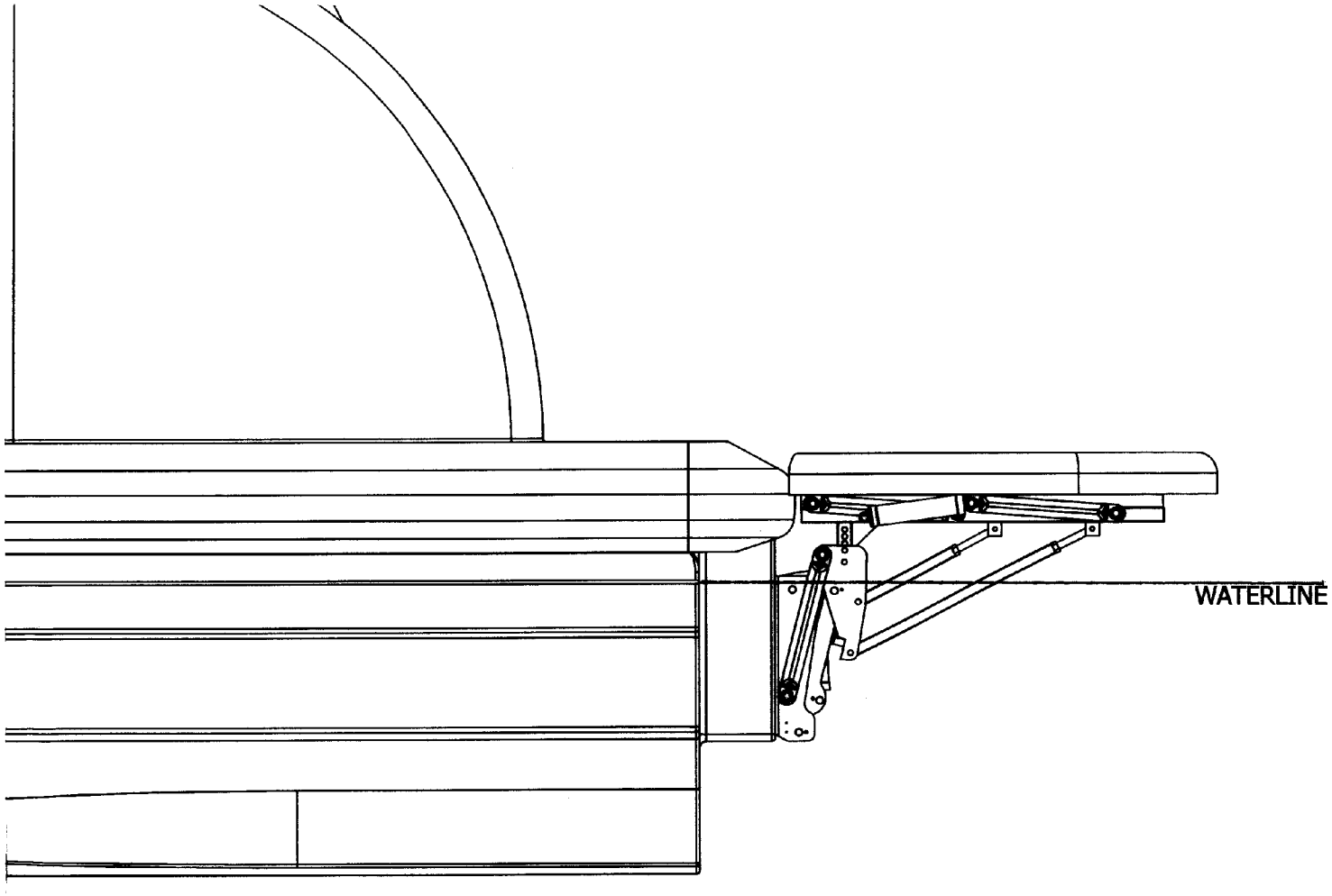
FIG. 8 is a side elevational view showing the platform in an in-line position through use of and in accordance with the present invention.
Figure 9:
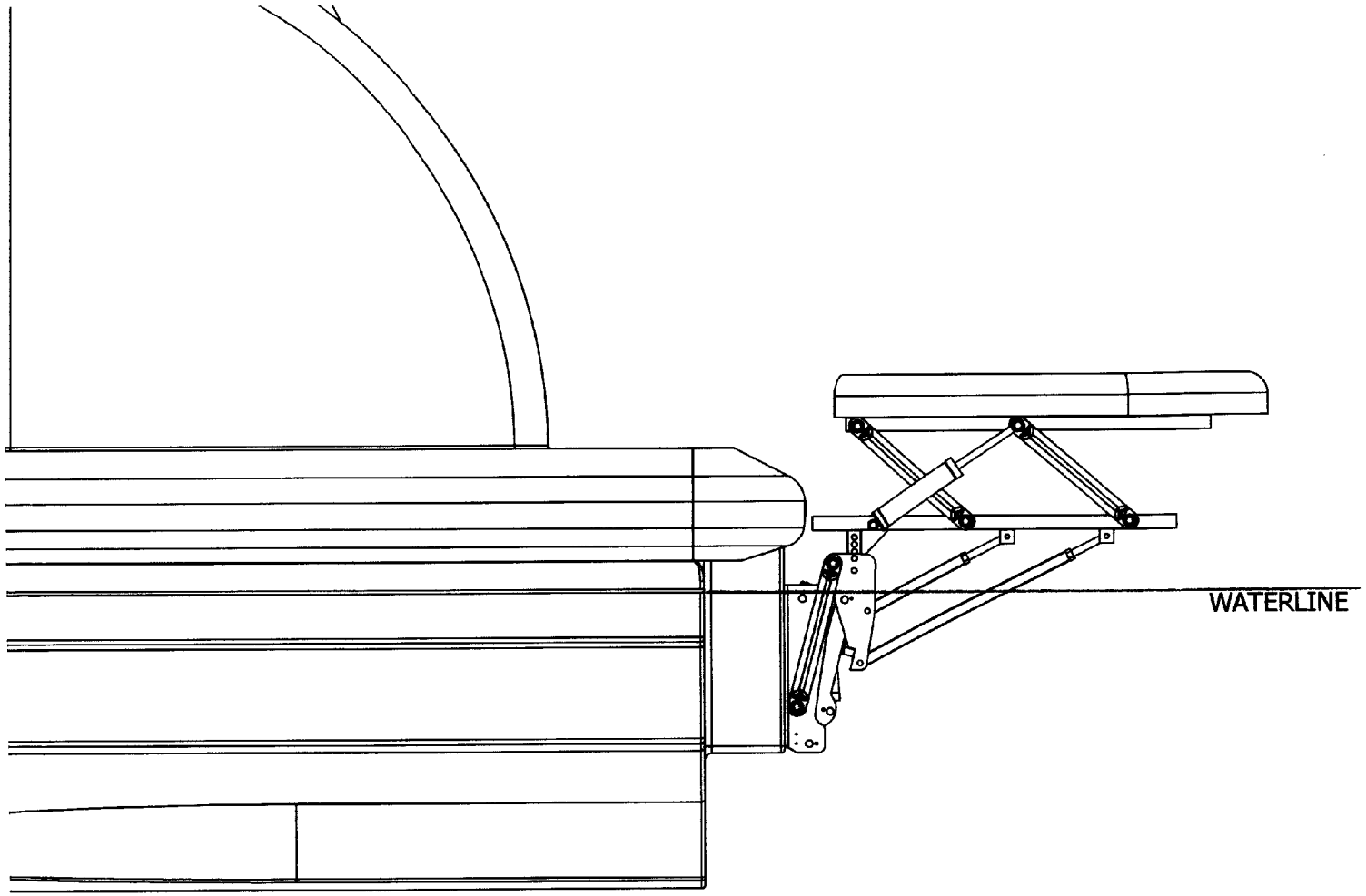
FIG. 9 is a side elevational view showing the platform in an uppermost position through use of and in accordance with the present invention.
Figure 10:
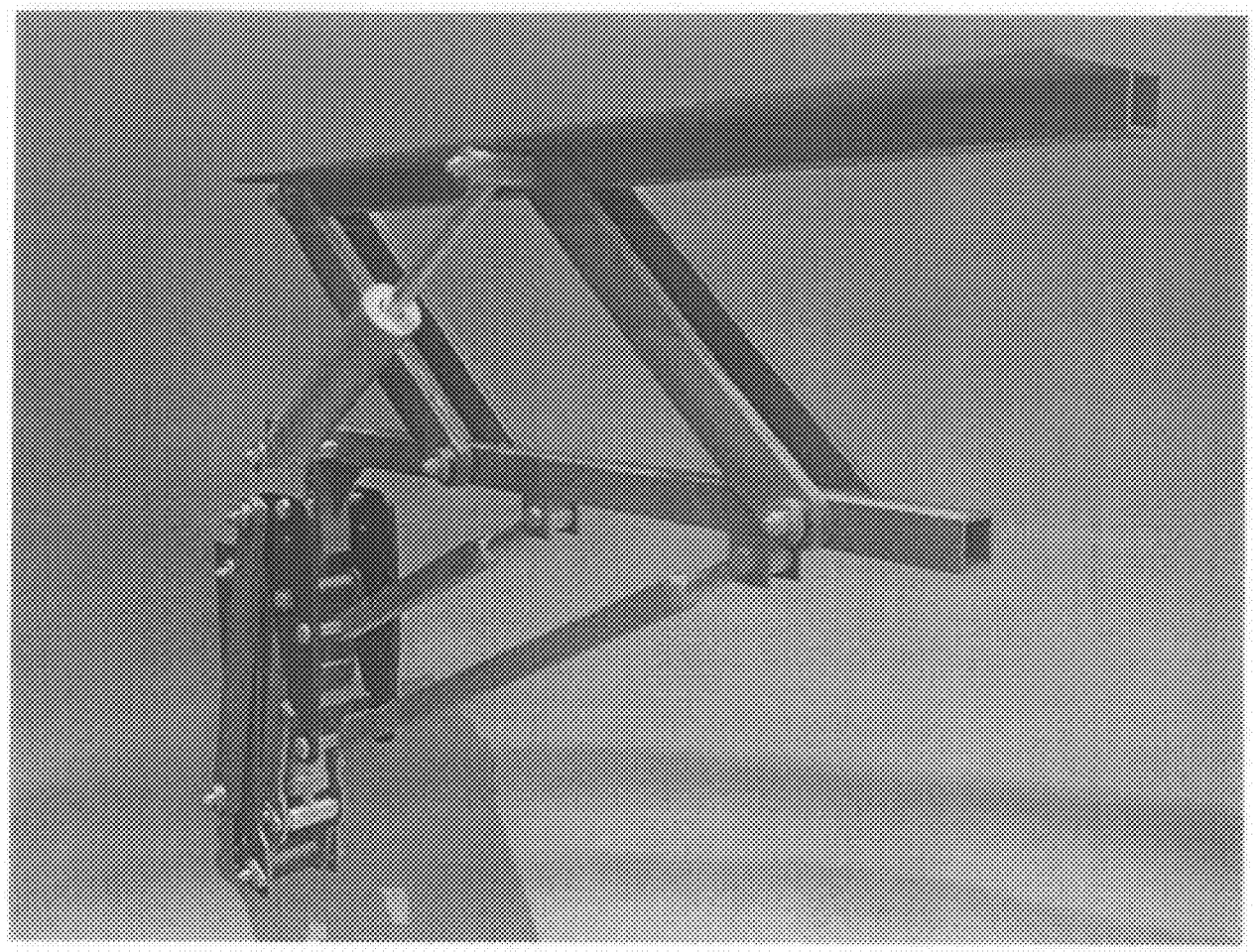
FIGS. 10 and 11 are perspective views of the two stage or double acting lift assembly of the present invention.
Figure 11:
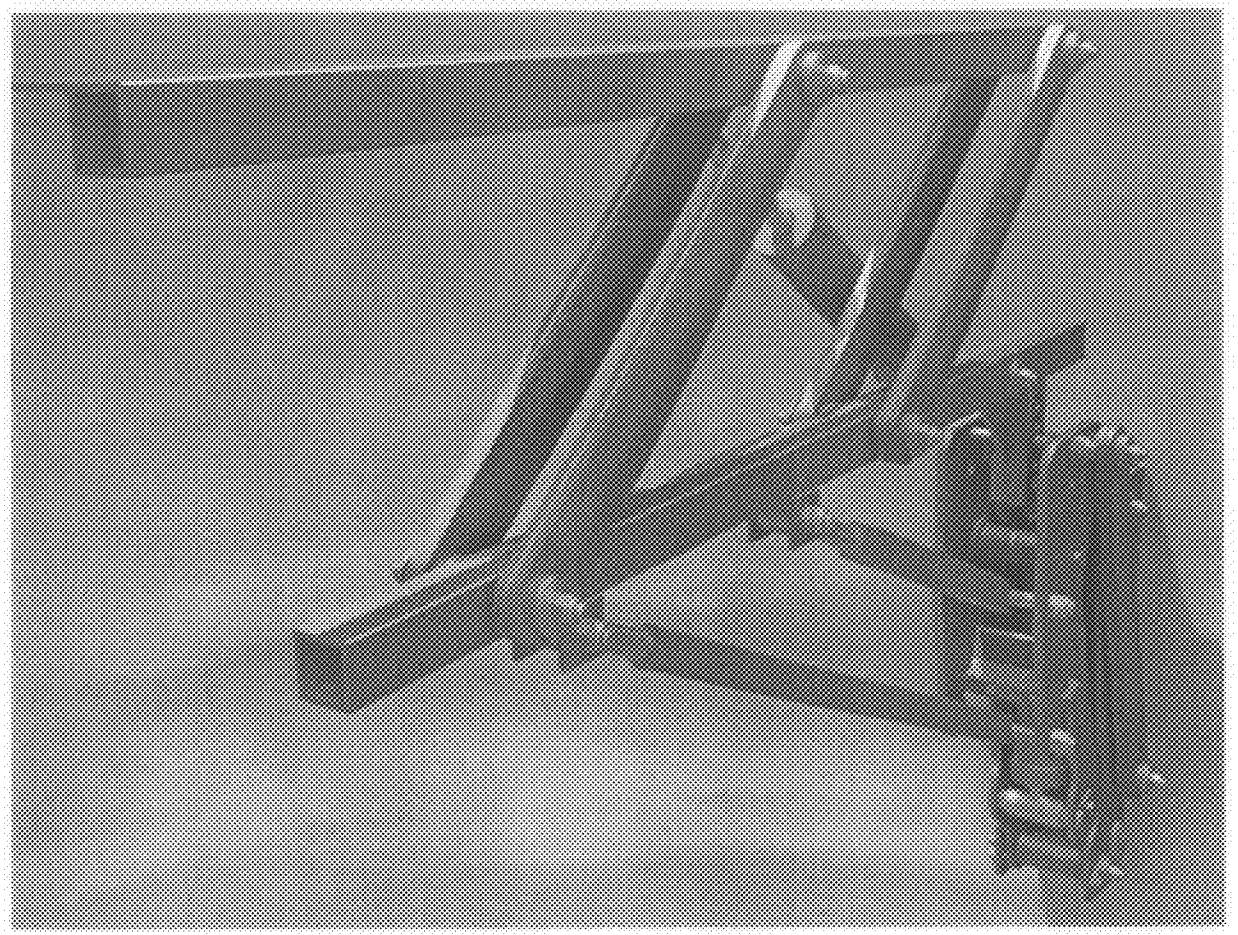

FIGS. 1 through 3 illustrate various views of the present invention two stage lift assembly for a boat swim platform. FIGS. 4 through 9 illustrate one embodiment of the present invention secured to the rear of a boat and illustrating the invention in several platform positions. FIGS. 10 and 11 illustrate isometric views of the two stage or double acting lift assembly of the present invention.

As seen in the Figures, the first stage lift assembly can be conventional, and can be a standard lift, with standard installation and standard hydraulics functionality. The present invention adds the conventional first stage lift assembly or mechanism by providing a second stage mechanism which provides a second lift mechanism for the secured platform.

The second stage lift mechanism can be provided with two cylinders (i.e. hydraulic, etc.), though such is not considered limiting. Lower or platform support arms accommodate the cylinders and provide pivoting points. Thus, the second stage lift mechanism is provided with its own set of platform support arms. In one embodiment, each lifting mechanism (preferably two lifting assemblies or mechanisms) of the second stage lift, can be provided with a plurality of arms, such as, but not limited to eight arms each. The eight arms articulate and can be linked to their respective cylinder which pushes to provide an additional vertical distance above the waterline (i.e. 14 inches, 16 inches, etc.).

The second stage cylinders can be to portion of the first stage lift mechanism, such as, but not limited to, the first stage platform support arm. The second stage cylinder can be provided with a couple of hydraulic lines coming off, which can be physically attached to that main support arm of the first stage or standard lift support arm. In one non-limiting embodiment, the second stage hydraulic lines go back to the first stage or original hydraulic assembly or hydraulic manifold, where additional hydraulic switches can be provided to control the second set of cylinders.

Thus, in one embodiment the standard hydraulic manifolds can be provided with a couple of switching valves for the second stage cylinders. In this non-limiting embodiment, the second stage cylinders can be dependent on the main set of cylinders (first stage) so they actually trigger the down stroke of our main lift cylinder. In this embodiment, the platform is lowered from the second stage level all the way down to below the water level, without stopping at the first stage level. Thus, the first stage level is reached by having the platform go up from the bottom level. However, this configuration is not considered limiting, and in another embodiment, the invention can be configured such that the platform can be lowered from the second stage level to the first stage level and then lowered below the water level. All various platform height control combinations can be used and all are considered within the scope of the invention (i.e. dashboard controls, wired handheld control, wireless handheld control, etc.).

In one embodiment, the motion of the second stage goes up in an isolated relationship as compared to the main stage (first stage). Thus, the main stage can be submerged (bottom level) and the upward motion of the platform can still be activated from a stand still in its natural stage which is the first stage lined up with the platform the upward motion is also isolated.

The platform itself is preferably secured to the second stage mechanism, such as by securing the platform to the second stage support arms which translate through the link arms that lead to the main stage. The articulating arm provides a pivoting member and can be constructed from steel arms (or other strong metals or materials) that are pivotally fixed at a first end to the first stage platform support arm or other part of the first stage lift mechanism. The second ends of the articulating arms are secured to the second stage platform support arm. Thus, when the second stage hydraulic cylinder is activated, the rod of the cylinder extends outward pushing up from the bottom of the platform and articulating pivot upwards from the first end attachment point.

When the second stage cylinder pushes or activates the arms, the platform can inherently motion either fore or aft a number of inches in some embodiments. Over the entire rising (i.e. 14 inches) of the platform in the second stage, the platform may step out a few inches based on the configuration of the second stage lift assembly. The slight movement or adjustment of the platform can also be based on the type of boat the lift assembly is to be secured to, as the structural characteristics of the rear of the boat (i.e. rear wall, rear deck, etc.) may require moving the platform slightly away while it rises in the second stage to avoid contacting the rear of the boat. Where a boat/yacht has a walk-out platform or fixed platform, the moveable platform may be moved closer towards the boat.

The platform is preferably secured to the support arm by self anchoring bolts, carriage bolts, rivets, etc. The bolt can go through the platform. Fiber glass and/or metal support tubes can be sandwiched or built into the platform to shrink platform. The bolts go through the platform, tubes and then go through the stainless steel support arms, which actually carry the load of the platform.

The control panel for controlling the lift mechanism can be a wired or wireless handheld device. Other locations on the boat and methods for controlling the lift assembly can also be used and are considered within the scope of the invention.

Other designs for lifting the platform in the second stage can also be used and are all considered within the scope of the invention. However, the articulating arm configuration described and shown herein is preferred, as it is able to come down and lie flat so that it is perfectly, or at least nearly perfectly, in line with the main support tubes. Thus, no additional draft is created, and no additional draft hangs down in the water, as it essentially lies completely flat with no adjustment to the current aesthetics of the main or first stage lift mechanism.

The second stage lift mechanism can have eight articulating support per side to bring up the platform in the second stage (i.e. per lifting mechanisms). There being preferably two lifting mechanisms yielding sixteen articulating arms in a preferred embodiment. However, such number is not considered limiting and less or more arms and/or lifting mechanisms can be provided and are considered within the scope of the invention.

The preferred sixteen arms (i.e. eight per side—in a doubled up parallel arm configuration), provides added strength, especially to compensate for any instability (reduces side-to-side platform motion) in the second stage.

Though not preferred four articulating arms per side could be used and is considered within the scope of the invention. The thickness of the metal for the arms can also be a factor in determining the number needed.

The eight articulating arms per side can be preferably in parallel with each other and not welded together, thus they are the isolated arms with respect to each other, which provide side-to-side platform stability.

When traveling in open waters in the second stage level, the platform can be secured to the boat using straps or other securing devices to provide two or more attachment points to secure that platform so that it becomes one with the actual boat.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modifications disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. A two stage lift assembly tier a height adjustable platform for use at the rear of a boat, said lift assembly comprising:

a platform;

a first stage lift assembly adapted for securement to a transom or rear area of a boat, said first stage lift assembly comprising:

a first substantially horizontal support arm associated with a first side of the boat and a second substantially horizontal support arm associated with a second side of the boat and at least one hydraulic cylinder, said first substantially horizontal support arm and said second substantially horizontal support arm supporting said platform in a substantially horizontal position from its fully down underwater position to its intermediate position where the platform is substantially in an in-line position with a fixed platform or deck of the boat, said first stage lift assembly moving said platform from the fully down underwater position to the substantially in-line position;

a second stage lift assembly for moving the platform from its in-line position to a raised position, said second stage lift assembly comprising;

a first pivotable support arm associated with the first side and having a first end pivotally secured to the first substantially horizontal support arm;

a second pivotable support arm associated with the second side and having a first end pivotally secured to the second substantially horizontal support arm;

a third substantially horizontal support arm associated with the first side and secured to a second end of said first pivotable support arm;

a fourth substantially horizontal support arm associated with the second side and secured to a second end of said second pivotable support arm;

a second hydraulic cylinder having a first fixed end secured to said first stage lift assembly at the first side and a movable second end secured at an intermediate portion of said third substantially horizontal support arm; and a third hydraulic cylinder having a first fixed end secured to said second stage lift assembly at the second side and a movable second end secured at an intermediate portion of said fourth substantially horizontal support arm;

wherein said platform secured to said third and fourth substantially horizontal support arms;

wherein said second and third hydraulic cylinders moving said platform from an in-line position to its raised position;

wherein when said platform is in its in-line position said first hydraulic cylinder is in a fully extended position and said second and third hydraulic cylinders are in a fully retracted position;

wherein when said movable platform is in its raised position with respect to the height of said in-line position said first hydraulic cylinder is in a fully extended position and said second and third hydraulic cylinders are also in their fully extended positions which causes said first and second pivotable support arms to be pivoted upwards to hold the third and fourth substantially horizontal support arms and the platform in a higher position as compared to the in-line position.

2. The two-stage lift assembly of claim 1 where the higher position is anywhere between approximately thirteen inches to approximately twenty inches above the in-line position.

3. The two-stage lift assembly of claim 1 wherein said platform is fixably secured to the third and fourth substantially horizontal support arms.

4. The two-stage lift assembly of claim 1 wherein said platform having a substantially planar upper surface,

* * * * *